US007314196B2

(12) United States Patent
Gandelheidt et al.

(10) Patent No.: US 7,314,196 B2
(45) Date of Patent: Jan. 1, 2008

(54) APPARATUS FOR HANDLING A FINISHED ROLL AND A WINDING SHAFT ON A WINDING APPARATUS FOR WEBS OF MATERIAL

(75) Inventors: Edgar Gandelheidt, Worms (DE); Jochen Hennes, Frankfurt (DE); Konrad Butty, Worms (DE)

(73) Assignee: Kiefel Extrusion GmbH, Worms (DE)

( * ) Notice: Subject to any disclaimer, the term of this patent is extended or adjusted under 35 U.S.C. 154(b) by 58 days.

(21) Appl. No.: 11/151,611

(22) Filed: Jun. 13, 2005

(65) Prior Publication Data

US 2005/0279876 A1 Dec. 22, 2005

(30) Foreign Application Priority Data

Jun. 16, 2004 (DE) ..... 10 2004 029 067

(51) Int. Cl.
*B65H 19/30* (2006.01)
*B65H 67/04* (2006.01)

(52) U.S. Cl. ..... 242/533.2

(58) Field of Classification Search ..... 242/473.6, 242/473.9, 533, 533.2, 533.3, 533.7, 533.8, 242/598.1, 598.4, 558, 559, 559.1; 414/908, 414/910, 431, 911, 680
See application file for complete search history.

(56) References Cited

U.S. PATENT DOCUMENTS 3,062,465 A 11/1962 Hunter
4,854,806 A * 8/1989 Gertsch et al. ..... 414/495
5,192,033 A * 3/1993 Pipes ..... 242/559.1
6,047,917 A 4/2000 Ekstrom et al.
6,250,580 B1 * 6/2001 Madrzak et al. ..... 242/533.2

FOREIGN PATENT DOCUMENTS

| | | |
|---|---|---|
| CA | 2 464 484 | 5/2003 |
| DE | 25 43 261 | 3/1977 |
| DE | 201 17 248 | 4/2003 |
| DE | 697 21 848 | 6/2004 |
| JP | 02056346 A * | 2/1990 |
| JP | 02147551 A * | 6/1990 |
| WO | WO 9308109 A1 * | 4/1993 |

* cited by examiner

*Primary Examiner*—Peter M. Cuomo
*Assistant Examiner*—William E Dondero
(74) *Attorney, Agent, or Firm*—Cohen Pontani Lieberman & Pavane LLP

(57) ABSTRACT

The apparatus for handling a finished roll and a winding shaft on a winding apparatus for webs of material is configured with spaced apart rails pivotal independently from one another between a winding station and a setting-down station. Each of the rails supports a carriage operative to support the winding shaft and release it upon pivoting the rails towards the setting-down station, where at least one of rails pivots away from the winding shaft so as to facilitate removal of the roll from the shaft.

6 Claims, 1 Drawing Sheet

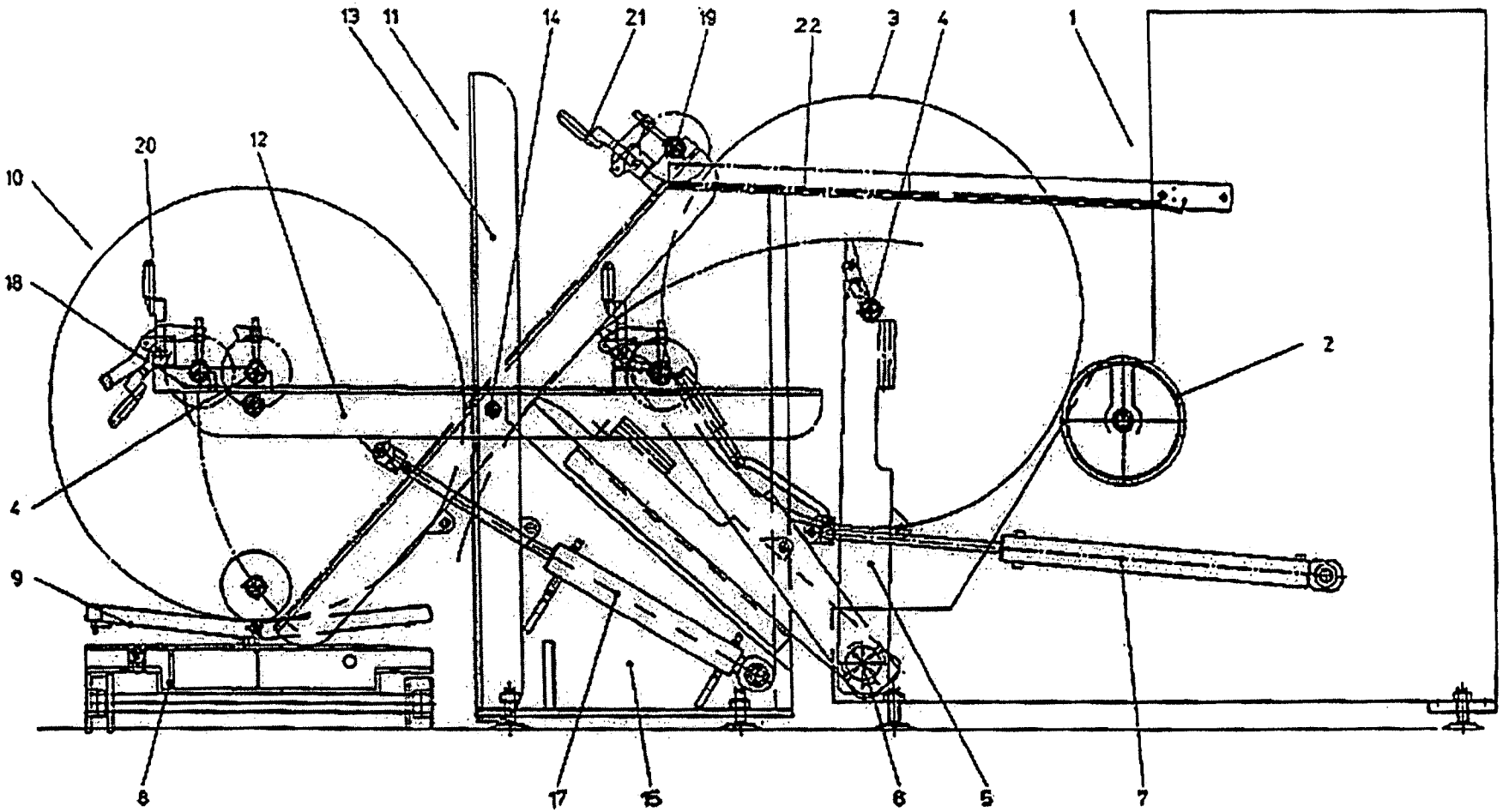
1
2
3
4
5
6
7
8
9
10
11
12
13
14
15
16
17
18
19
20
21
22

APPARATUS FOR HANDLING A FINISHED ROLL AND A WINDING SHAFT ON A WINDING APPARATUS FOR WEBS OF MATERIAL

BACKGROUND OF THE INVENTION

1. Field of the Invention

The invention relates to an apparatus for handling a finished roll and a winding shaft on a winding apparatus for webs of material.

2. Description of the Related Art

For setting down a finished roll and returning the winding shaft, lifting tables are used together with cranes, which is not only complicated with respect to the equipment involved but also laborious and time-consuming for the operators.

A need therefore exists for an apparatus which is of a simple structural design and makes it possible for a finished roll to be handled easily and quickly when setting it down and for the winding shaft.

SUMMARY OF THE INVENTION

This need is satisfied by two double-armed sliding rails pivotably mounted independently of each other on a fixed base frame in the region between a winding station and a setting-down station of the winding apparatus for the roll. The rails have respective independent driving devices for the pivoting movement and support a transporting carriage for the winding shaft arranged on the sliding rails in such a way that it can move along the entire length of the sliding rails.

In use, the inventive apparatus provides for engaging the finished roll at the winding station and displacing it on the sliding rails in a way dependent on the diameter of the roll until the latter can be set down at a desired location of a setting-down station. Handling of the finished roll is realized by pivoting or lowering that end of the sliding rails which is carrying the roll. Since the sliding rails are pivotable independently of each other, one sliding rail can then be pivoted away so far that the roll can be pulled off the winding shaft and transported away. After the finished roll has been unloaded from the winding shaft, the shaft returns to the winding apparatus for engaging a new roll by means of the transporting carriage along the sliding rails and by corresponding pivoting movement to a takeover location of the winding apparatus, where the winding shaft can then be introduced into the winding station by known devices on the winding apparatus. The apparatus according to the invention is therefore simple in its structural design and easy to operate when handling a finished roll and when returning the winding shaft.

The handling when transferring the roll from the winding station to the setting-down station and returning the winding shaft to the winding station is further improved and facilitated in an advantageous way if, in a development of the invention, each transporting carriage has a travel drive of its own.

To allow the winding shaft to be held securely on the transporting carriage, in a further refinement of the invention each transporting carriage has a holding device for the winding shaft. This may preferably be formed as a clamping device which can be easily and quickly used and released again.

If, in an advantageous further refinement of the invention, at least one of the two sliding rails has a holding device for the winding shaft, it is possible to fix the latter in order to allow the roll to be pulled off the winding shaft, the sliding rail lying opposite being removed from the path of movement of the roll that is to be pulled off.

A particularly simple and advantageous refinement for the pivoting of the sliding rails is obtained by the pivoting of the sliding rails taking place in each case by means of a hydraulic cylinder or pneumatic cylinder.

The invention is explained in more detail below on the basis of an exemplary embodiment.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

A single FIGURE shows a side view of a winding apparatus together with an apparatus according to the invention for handling a roll.

DETAILED DESCRIPTION OF THE PRESENTLY PREFERRED EMBODIMENTS

In a winding apparatus for webs of material which is designated overall by 1, in the winding station, which has a transporting roller 2 for the web of material to be wound up, there is shown a ready-wound roll 3, which is held by two parallel supports 5, which are mounted such that they can pivot about a bearing 6 with the aid of a hydraulic cylinder 7. This pivotable securement is necessary in order to keep the roll 3 in contact with the transporting roller 2 over which the web of material to be wound up on the roll 3 is being delivered.

As can also be seen from the FIGURE, after its completion, the roll 3 is to be set down on a transporting means 8 which has a prismatic surface 9 in order to prevent the roller 3 from rolling off the transporting means 8. The transport direction runs in the direction of the winding shaft 4.

An apparatus 11 then displaces the finished roll 3 from the winding station into the setting-down station designated by 10. The apparatus 11 employs two sliding rails 12 and 13, which are pivotally mounted about a pivot axis 14 independently of each other on a base frame 15. Respective hydraulic cylinders 17, only one of which is shown, serve for pivoting the sliding rails 12, 13.

On each sliding rail 12 and 13, respective transporting carriages 18 and 19 are arranged such that they can move along these sliding rails. The carriages each have a travel drive and a holding device 20 and 21, respectively. The holding devices 20 and 21 serve for firmly clamping the winding shaft 4 on the transporting carriage.

The apparatus operates in the flowing manner. The two supports 5, which support the winding shaft 4 at its opposite ends, are pivoted in the direction of the horizontally aligned sliding rails 12 and 13, so as to transfer the finished roll 3 onto both transporting carriages 18 and 19 on the sliding rails 12 and 13, respectively. There, the winding shaft 4 is firmly clamped by means of the holding devices 20 and 21. After securing the shaft, both transporting carriages travel on the sliding rails until the winding shaft 4 is located centrally over the transporting means 8. Then, the two sliding rails are pivoted downward by means of the hydraulic cylinders 17, until the roll 3 rests on the prismatic surface 9 of the transporting means 8. By means of a holding device that is not represented in the drawing, one of the opposite ends of the winding shaft 4 is firmly held on one of the sliding rails, for example the rail 12. The other rail 13 is released from engagement with the other end of the shaft 4 and pivoted into a vertical position, in which it the roll 3 is axially pulled off the winding shaft 4 by the transporting means 8. After that, the sliding rail 13 is pivoted up again to the winding shaft, which is still held on the other sliding rail, and, together with the other sliding rail, the winding shaft is then brought into a transfer position, where the winding shaft can be delivered onto a transfer rail 22. With devices that are present there and not represented in the drawing, the winding shaft can then be returned to the supports 5 for the winding-on of a new web of material. Provided for all these movements is a control device, which controls the traveling path of the transporting carriages in dependence on the diameter of the roll and the pivoting movement of the sliding rails.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for handling a winding shaft with a roll of web material removably wound on the winding shaft, the apparatus comprising:

a base frame;

two guiding rails mounted on the base frame between a winding station and a setting-down station and spaced apart across the winding shaft, each of the guiding rails being independently pivotable about a common pivot axis fixed relative to the base frame, each of the two guiding rails having first and second ends, each of the two guiding rails being double-armed in that each of the two guiding rails includes a first arm between the pivot axis and the first end and a second arm between the pivot axis and the second end; and two carriages respectively mounted to the two guiding rails, the two carriages being configured to support and transport the winding shaft with the roll along substantially an entire length of the two guiding rails between the first and second ends from the winding station to the setting-down station upon pivoting the two guiding rails.

2. The apparatus of claim 1, further comprising two actuators mounted on the base frame and configured to respectively pivot the two guiding rails.

3. The apparatus of claim 2, wherein each of the actuators comprises a hydraulic cylinder or a pneumatic cylinder.

4. The apparatus of claim 1, wherein the carriages have respective drive units operable for displacing the carriages along the two guiding rails.

5. The apparatus of claim 1, wherein each of the carriages comprises a holding device configured to hold the winding shaft, at least one of the carriages being disengageable from the winding shaft at the setting-down station to allow the one of the two guiding rails associated with the at least one of the carriages to pivot away from the winding shaft for removal of the roll from the winding shaft.

6. The apparatus of claim 1, wherein at least one of the carriages comprises a holding device configured to releasably hold the winding shaft.

* * * * *